US010173115B2

(12) United States Patent
Rost

(10) Patent No.: US 10,173,115 B2
(45) Date of Patent: Jan. 8, 2019

(54) ADJUSTABLE TRAINING GOLF TEE

(71) Applicant: FITS TO A TEE GOLF, LLC, Tinton Falls, NJ (US)

(72) Inventor: Greg Rost, Tinton Falls, NJ (US)

(73) Assignee: FITS TO A TEE GOLF, LLC, Tinton Falls, NJ (US)

( * ) Notice: Subject to any disclaimer, the term of this patent is extended or adjusted under 35 U.S.C. 154(b) by 0 days.

(21) Appl. No.: 15/391,308

(22) Filed: Dec. 27, 2016

(65) Prior Publication Data

US 2017/0106258 A1 Apr. 20, 2017

Related U.S. Application Data

(62) Division of application No. 14/593,861, filed on Jan. 9, 2015, now Pat. No. 9,561,415.

(51) Int. Cl.

| | |
|---|---|
| ***A63B 57/10*** | (2015.01) |
| ***A63B 57/13*** | (2015.01) |
| ***A63B 57/15*** | (2015.01) |
| ***A63B 57/00*** | (2015.01) |
| ***A63B 69/36*** | (2006.01) |
| *A63B 71/06* | (2006.01) |

(52) U.S. Cl.

CPC ..... *A63B 57/15* (2015.10); *A63B 57/0037* (2013.01); *A63B 57/10* (2015.10); *A63B 57/13* (2015.10); *A63B 69/3623* (2013.01); *A63B 2071/0694* (2013.01); *A63B 2208/0204* (2013.01)

(58) Field of Classification Search

CPC ..... A63B 57/15; A63B 69/3623; A63B 2208/0204; A63B 57/10; A63B 57/12; A63B 57/13; A63B 57/16; A63B 57/19; A63B 57/18

See application file for complete search history.

(56) References Cited

U.S. PATENT DOCUMENTS

| | | | | |
|---|---|---|---|---|
| 2,531,470 A * | 11/1950 | Rickard | ..... | A63B 57/10 473/396 |
| 4,610,451 A * | 9/1986 | Keys | ..... | A63B 57/10 473/268 |
| 4,786,054 A * | 11/1988 | Keys | ..... | A63B 57/10 473/268 |
| 6,682,443 B1 * | 1/2004 | Liu | ..... | A63B 57/10 473/387 |
| 2006/0217217 A1 * | 9/2006 | Mundziakiewicz | ... | A63B 57/10 473/396 |

(Continued)

*Primary Examiner* — Steven Wong

(74) *Attorney, Agent, or Firm* — Dunlap Bennett & Ludwig PLLC

(57) ABSTRACT

An adjustable training golf tee is provided. The adjustable training golf tee may include a top body, a stem and a base. The top body may have a first side and a second side, wherein the second side forms a concentric threaded recess, wherein the first side forms a concentric stem aperture communicating the first side to the threaded recess. The stem may have a first end and a second end, wherein the first end is dimensioned and adapted to rest a golf ball thereon. The base may include a threaded flange and a spike perpendicularly joined thereto, wherein the threaded recess is dimensioned and adapted to rotatably mate with the threaded flange, and wherein the stem aperture is dimensioned and adapted to be slidably receive the stem secured to the base.

1 Claim, 5 Drawing Sheets

(56) References Cited

U.S. PATENT DOCUMENTS

| | | | | |
|---|---|---|---|---|
| 2007/0004538 | A1* | 1/2007 | Lim | A63B 57/10<br>473/387 |
| 2007/0149324 | A1* | 6/2007 | Tsai | A63B 57/16<br>473/387 |
| 2007/0298909 | A1* | 12/2007 | Lu | A63B 57/12<br>473/393 |
| 2009/0181806 | A1* | 7/2009 | Wood | A63B 57/0012<br>473/397 |
| 2016/0199709 | A1* | 7/2016 | Rost | A63B 57/13<br>473/398 |

* cited by examiner

ADJUSTABLE TRAINING GOLF TEE

CROSS-REFERENCE TO RELATED APPLICATION

This application claims the benefit of priority of U.S. non-provisional application Ser. No. 14/593,861, filed 9 Jan. 2015, the contents of which are herein incorporated by reference.

BACKGROUND OF THE INVENTION

The present invention relates to the sport of golf and, more particularly, to a practice golf tee that is adjustable in height for supporting a golf ball at a desired, consistent elevation.

In order to develop a consistent golf club swing, one needs to maintain consistent ball tee level. When first learning the game of golf or a seasoned player, not establishing correct tee height in relationship to the club being used, prolongs the development of a consistent swing.

Current training tees are made of wood or other material that typically limits them to being securely placed in the natural earth. As a result, such tees are easily broken and/or become dislodged and thrown out of their original placement. These broken and/or damaged golf tees can cause damage to maintenance equipment that is used to maintain said practice areas.

As can be seen, there is a need for a resilient practice golf tee that is adjustable in height for supporting a golf ball at a desired, consistent elevation. Said practice golf tee is adapted to be used on various natural earth surfaces (sand, high grass, snow, etc.) because of its resiliency, as well as that it eliminates the need to buy replacements and aids in preventing damage to maintenance equipment by keeping the surrounding placement surface free of broken golf tees.

SUMMARY OF THE INVENTION

In one aspect of the present invention, an adjustable training golf tee comprises: a top body having a first side and a second side, wherein the second side forms a concentric threaded recess, wherein the first side forms a concentric stem aperture communicating the first side to the threaded recess; a stem having a first end and a second end, wherein the first end is dimensioned and adapted to rest a golf ball thereon; and a base comprising: a threaded flange; and a spike perpendicularly joined to the center of the threaded flange, wherein the threaded recess is dimensioned and adapted to rotatably mate with the threaded flange, and wherein the stem aperture is dimensioned and adapted to slidably receive the stem.

In another aspect of the present invention, an adjustable training golf tee comprises: a top body comprising: a second side, wherein the second side forms at least one concentric recess; and a first side, wherein the first side forms a concentric stem aperture communicating the first side to the at least one concentric recess; and a concentric sleeve perpendicularly joined along a periphery of the stem aperture disposed on the second side; a stem comprising: a first end, wherein the first end is dimensioned and adapted to rest a golf ball thereon; a second end; and a lift anchor connected to the second end; and a base comprising: a tubular body housing a threaded chamber, wherein the lift anchor is dimensioned and configured to rotatably ride along the threaded chamber; a spike perpendicularly joined to one end of the tubular body; and a collar flange perpendicularly joined along a periphery of an opposing end of the tubular body, wherein the at least one concentric recess is dimensioned and adapted to slidably receive the collar flange.

In yet another aspect of the present invention, a method for developing a consistent golf club swing using providing a system comprising: the adjustable training golf tee; a golf ball; and a surface tool comprising: a prying end forming two tines; a surface prep end; and a traverse bend between the prying end and the surface prep end, comprises: prepping a horizontal surface grade with the surface prepping end of the surface tool; driving the spike of the adjustable training golf generally perpendicularly into the prepped horizontal surface grade; rotating the top body of the adjustable training golf tee so that the lift anchor rides along the threaded chamber until the elevation of the first end of the stem is at a predetermined elevation above the horizontal surface grade; resting the golf ball on the first end of the stem; repeatedly swinging a predetermined golf club at the golf ball consistently elevated to the predetermined elevation; and prying the adjustable training golf tee from the horizontal surface grade by using pry end of the surface tool.

These and other features, aspects and advantages of the present invention will become better understood with reference to the following drawings, description and claims

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an adjustable training golf tee may include a top body, a stem and a base. The top body may have a first side and a second side, wherein the second side forms a concentric threaded recess, wherein the first side forms a concentric stem aperture communicating the first side to the threaded recess. The stem may have a first end and a second end, wherein the first end is dimensioned and adapted to rest a golf ball thereon. The base may include a threaded flange and a spike perpendicularly joined thereto, wherein the threaded recess is dimensioned and adapted to rotatably mate with the threaded flange, and wherein the stem aperture is dimensioned and adapted to be slidably receive the stem secured to the base.

Referring to FIGS. 1 through 16, the present invention may include a training system embodying an adjustable training tee, a surface tool 130 and a method for use in training golfers by providing a consistent ball tee level that is adjustable to meet the needs of the particular training. The adjustable tee may include at least three embodiments, and the surface tool 130 may provide at least two embodiments.

Figure 1:
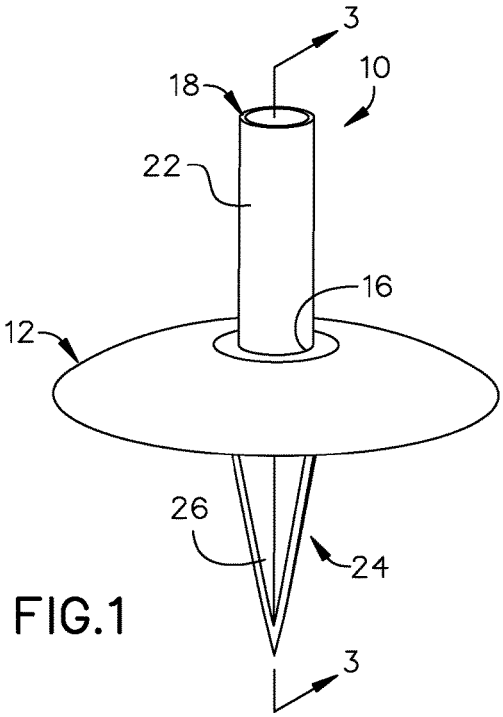
FIG. 1 is a perspective view of an exemplary embodiment of the present invention.
Figure 2:
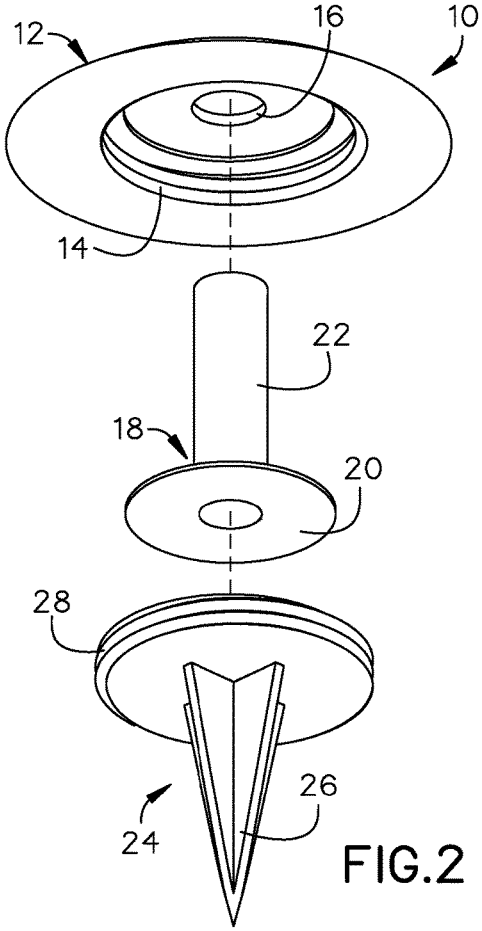
FIG. 2 is an exploded perspective view of an exemplary embodiment of the present invention.
Figure 3:
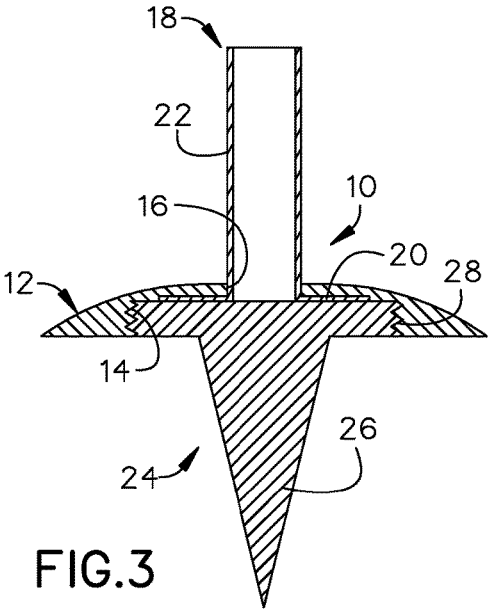
FIG. 3 is a cut-a-way section view of an exemplary embodiment of the present invention, taken along line 3-3 in FIG. 1.

A first embodiment 10 of the adjustable tee may be illustrated in FIGS. 1 through 3. The first embodiment 10 may provide a first top 12 forming a dome-like shape having a curved surface and a flat surface. The flat surface may form a threaded recess 14. The curved surface may form a tee aperture 16 communicating with the treaded recess 14, whereby the first top 12, the threaded recess 14, and the tee aperture 16 are generally concentric.

The first embodiment 10 may provide a first base 24. The first base 24 may include insertion disc 28 perpendicularly joined to a base spike 26. The disc 28 may have threads along its periphery that cooperate with the threading of the threaded recess 14. The disc 28 may be dimensioned and adapted to snugly fit into the threaded recess 14 so that the cooperating threads securely mate.

The first embodiment 10 may provide a mat tee 18. The mat tee 18 may have a tube 22 that terminates in a concentric flange 20.

The disc 28 threading may be dimensioned and adapted to operably engage the threaded recess 14 so as to removably sandwich the concentric flange 20 within the recess 14 while the tube 22 protrudes from the tee aperture 16, as illustrated in FIG. 3.

Figure 4:
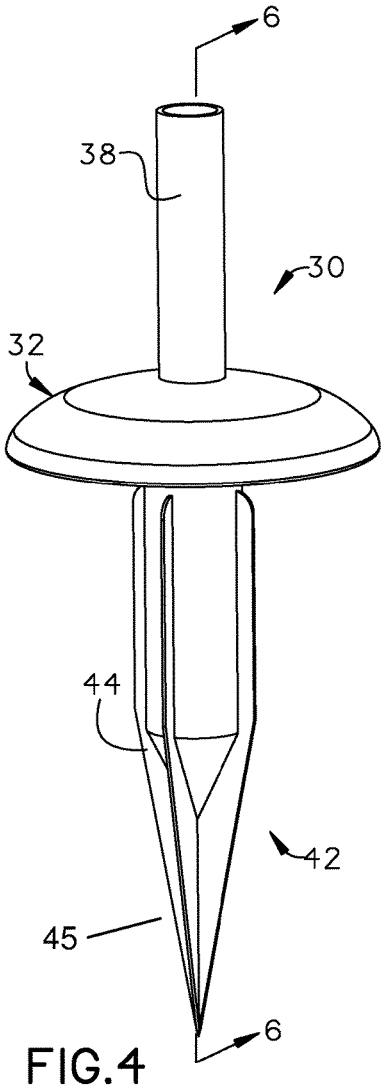
FIG. 4 is a perspective view of an exemplary embodiment of the present invention.
Figure 5:
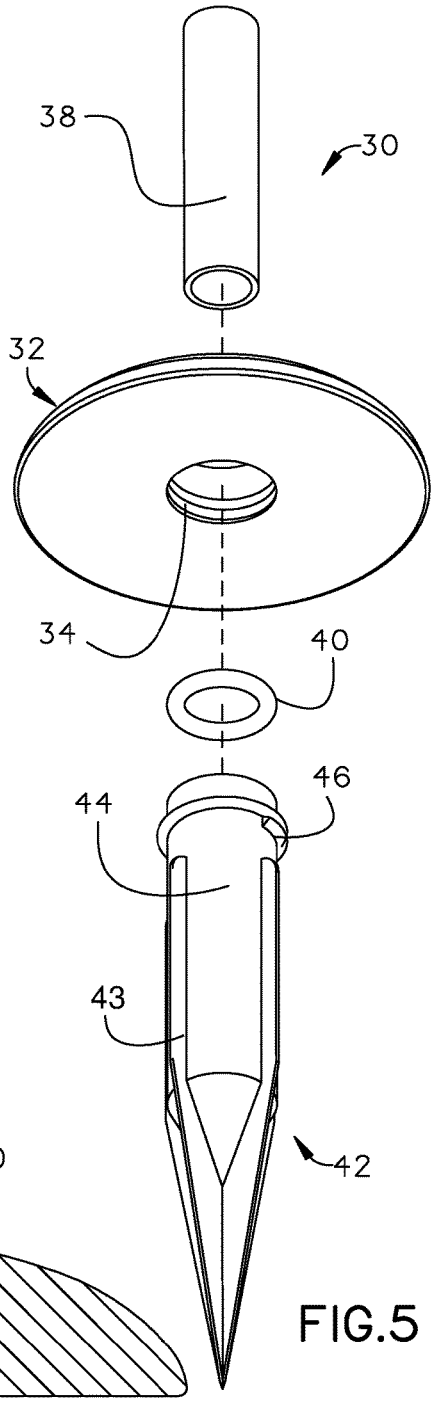
FIG. 5 is an exploded perspective view of an exemplary embodiment of the present invention.
Figure 6:
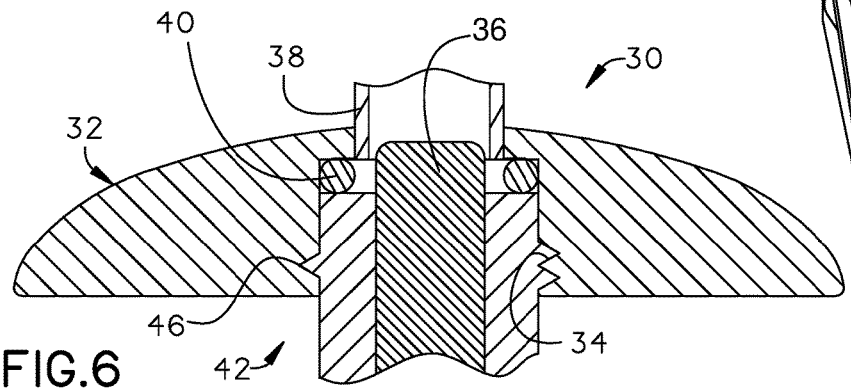
FIG. 6 is a cut-a-way section view of an exemplary embodiment of the present invention, taken along line 6-6 in FIG. 4.

A second embodiment 30 is illustrated in FIGS. 4 through 6. The second embodiment 30 may provide a second top 32 forming a dome-like shape having a curved surface and a flat surface. The flat surface may form a threaded recess 34 communicating with a concentric yet smaller stem aperture of the curved surface. The curved surface may have at least one distinguishable strike line (not shown) bisecting the curved surface but for the threaded aperture 34.

The second embodiment 30 may provide a second base 42 having a tubular body 44 with a first end and an opposing second end. The first end may define an opening. In certain embodiments, the tubular body 44 may house a core 36. The second end may form a tapering spike 45 adapted to puncture a grade surface. The tapering spike 45 may provide a plurality of perpendicularly joined spike plates 43. The second base 42 may provide a male threading 46 along its periphery near the first end. The male threading 46 may be adapted to cooperate with the threading of the threaded aperture 34 so as to detachably mate together.

The second embodiment 30 may provide an annular grommet 40 and a second stem 38. The stem aperture and the first end opening may be dimensioned so as to slidably receive the second stem 38 wherein a diameter of the first end and a diameter of the threaded recess 34 exceeds a diameter of the stem aperture, as illustrated in FIG. 6.

The core 36 may be dimensioned to slide into the second stem 38 as the latter slides through the first end opening. The annular grommet 40 may be dimensioned and adapted to be operably sandwiched between the first end and a terminus of the threaded recess 34 when the male threading 46 and the threading of the threaded recess 34 are operably engaged. The annular grommet 40 may be made of elastic material including, but not limited to rubber. When the grommet 40 is increasingly squeezed by the operable engagement of the threading 46, 34 the annular grommet 40 transversely expands to frictionally engage the second stem 38, thereby locking the second stem 38 at a desired elevation relative to the flat surface. The flat surface being generally flush with the surface grade when the present invention is in use. In certain embodiments, the transversely expanding grommet 40 may urge an adjacent portion of the second stem 38 against the core 36 within the stem 38 so as to urge a frictional engagement thereto.

The second stem 38 may provide evenly spaced longitudinal graduation marks (not shown) along its length so that a user may determine when the desired elevation has been reached.

Figure 7:
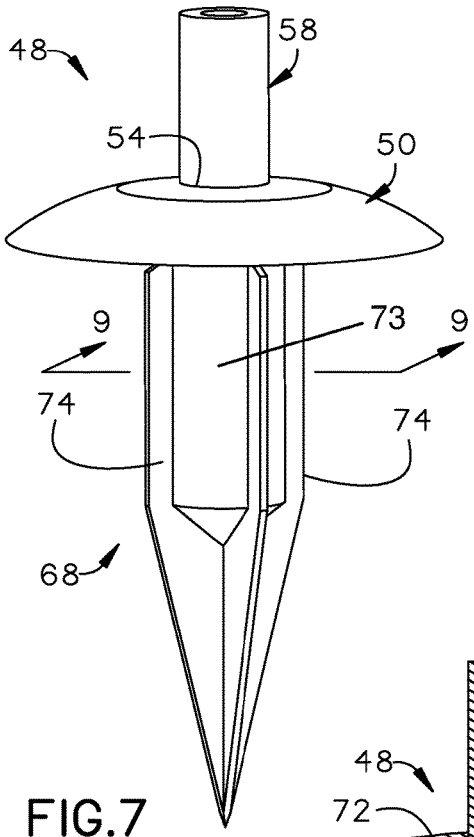
FIG. 7 is a perspective view of an exemplary embodiment of the present invention.
Figure 9:
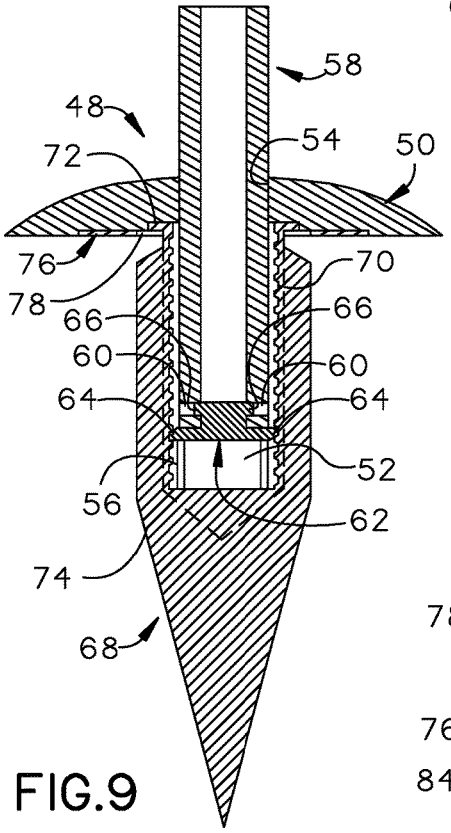
FIG. 9 is a cut-a-way section view of an exemplary embodiment of the present invention, taken along line 9-9 in FIG. 7.
Figure 8:
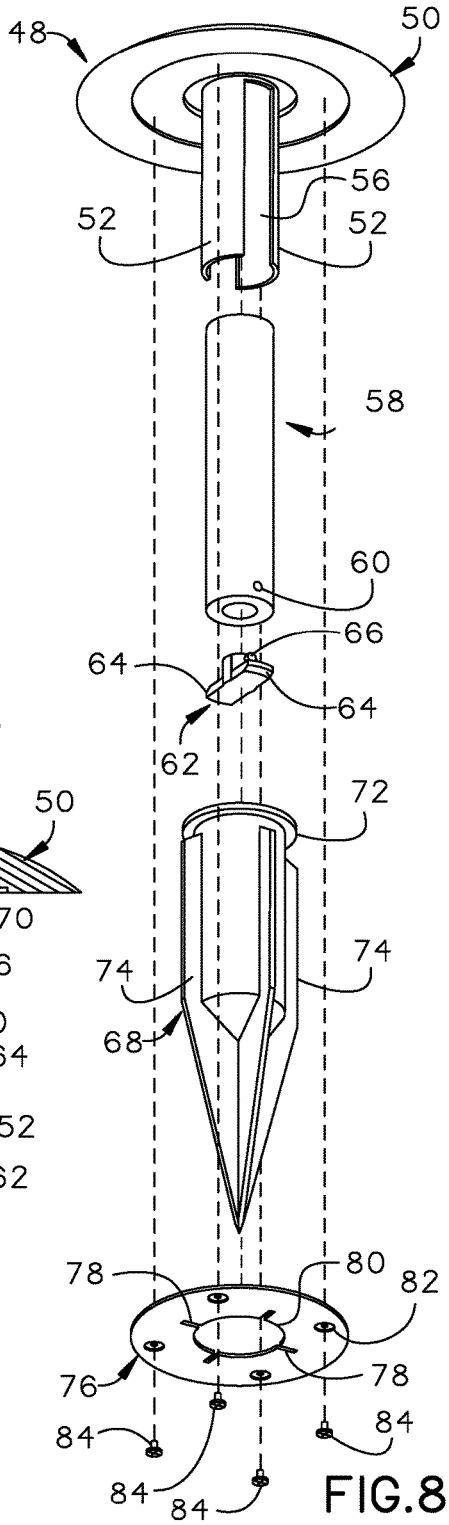
FIG. 8 is an exploded perspective view of an exemplary embodiment of the present invention.

A third embodiment 48 is illustrated in FIGS. 7 through 9. The third embodiment 48 may provide a third top 50 forming a dome-like shape having a curved surface and a flat surface. The flat surface may form two concentric recesses. The curved surface may form a stem aperture 54 communicating with the inner concentric recess. A sleeve 52 may circumscribe the stem aperture 54 on the flat surface that it perpendicularly extends from. The sleeve 52 may provide slots 56.

The sleeve 52 may be dimensioned and adapted to slidably receive a stem 58. The stem 58 may provide at least two pinholes 60 near a second end.

The third embodiment 48 may provide a third base 68 having a cylindrical body 73 with a first end and an opposing second end. The first end may define a first opening communicating to a threaded chamber 70. The second end may form a tapering spike adapted to puncture a grade surface. The tapering spike may include a plurality of perpendicularly joined spike plates 74. The third base 68 may provide a collar flange 72 along a periphery of the first opening. The collar flange 72 may be dimensioned and adapted to cooperating with the inner concentric recess of the third top 50 flat surface.

The third embodiment 48 may provide a lift anchor 62. The lift anchor 62 may be T-shaped wherein the trunk of the "T" provides at least one pin 66 for removably securing the at least two pinholes 60 so that the lift anchor 62 is disposed at the end of the second end. The arms 66 of the "T" may be dimensioned and adapted to operably engage the threaded chamber 70 so that the elevation of the stem 58 may be "lifted" or adjusted by rotating the lift anchor 62 secured to the stem 58. In certain embodiments, such rotation may be enabled by rotating the third top 50 wherein an annular locking ring 76 sandwiches the collar flange 72 into the inner concentric recess of the third top 50. The annular locking ring 76 may provide an opening 80 and a plurality of slots 78 for slidably receiving the third base 68 and its plurality of spike plates 74, respectively. The annular locking ring 76 may be secured within the outer concentric recess of the third top 50 by a plurality of fasteners 84 through cooperating fastener holes 82.

Figure 10:
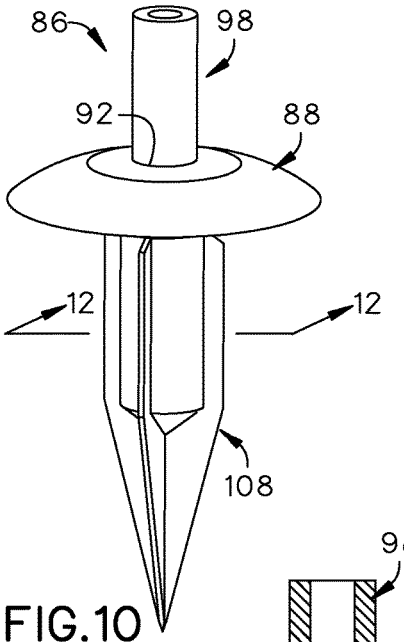
FIG. 10 is a perspective view of an exemplary embodiment of the present invention.
Figure 12:
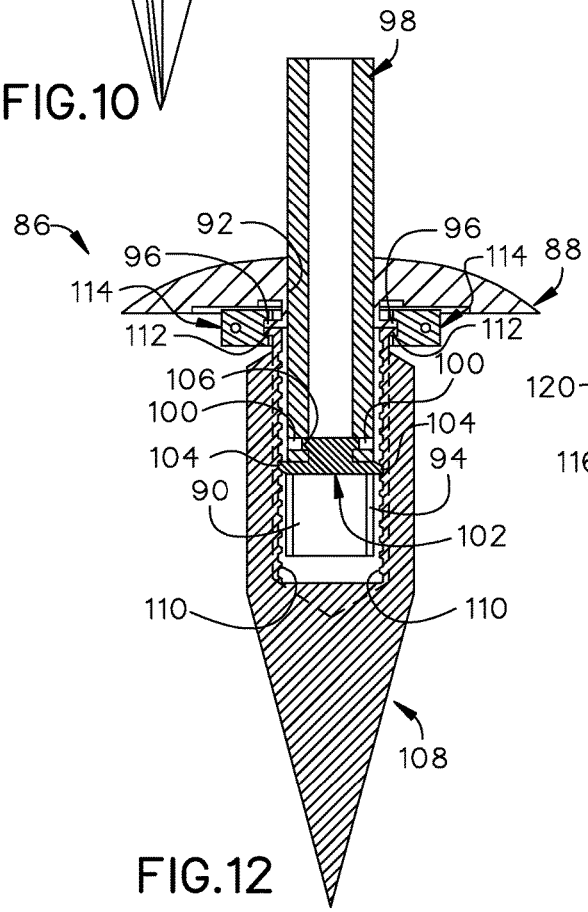
FIG. 12 is a cut-a-way section view of an exemplary embodiment of the present invention, taken along line 12-12 in FIG. 10.
Figure 11:
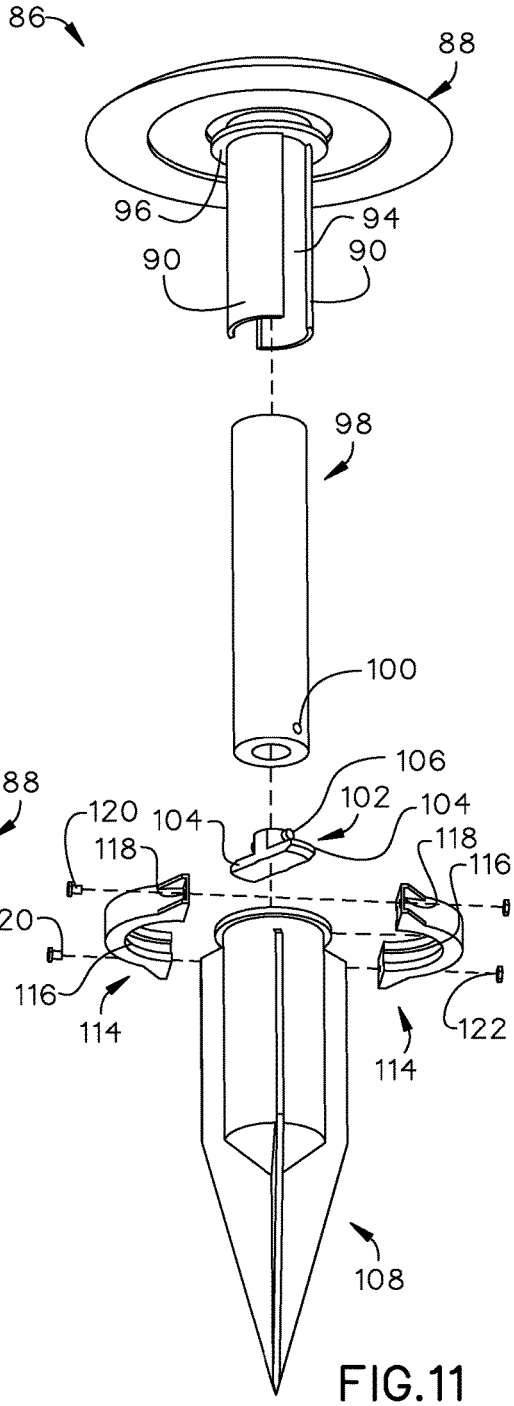
FIG. 11 is an exploded perspective view of an exemplary embodiment of the present invention.
Figure 13:
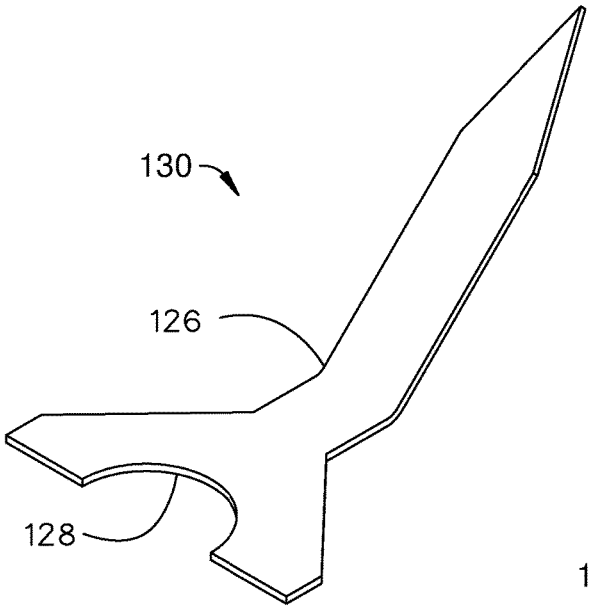
FIG. 13 is a perspective view of an exemplary embodiment of a surface tool of the present invention.
Figure 14:
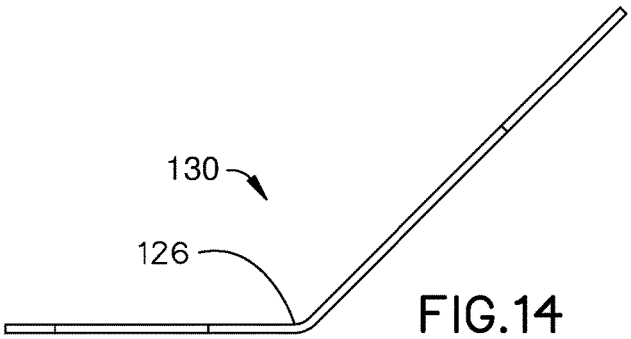
FIG. 14 is a side view of an exemplary embodiment of the surface tool of the present invention.
Figure 15:
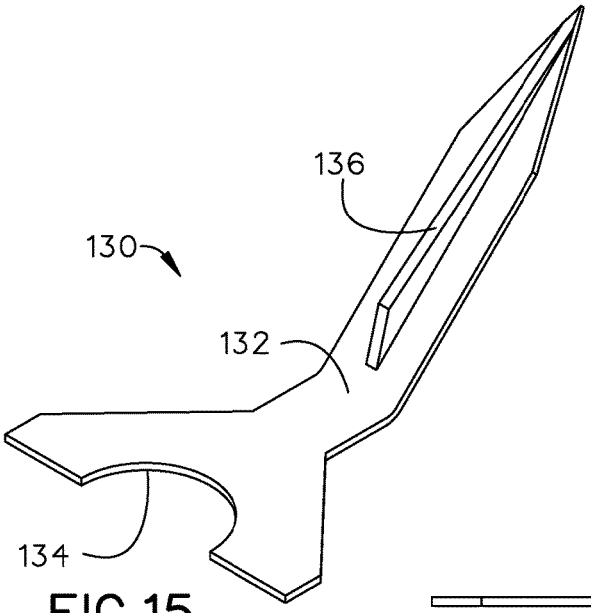
FIG. 15 is a perspective view of an exemplary embodiment of the surface tool of the present invention.
Figure 16:
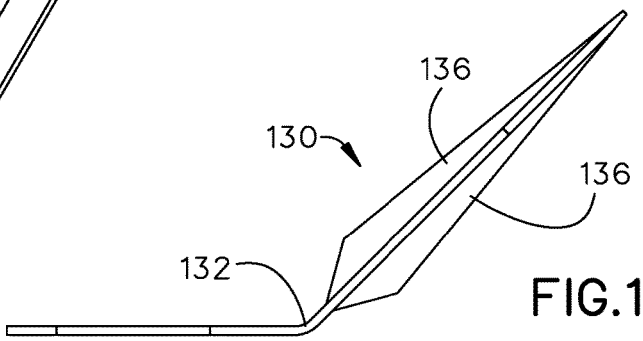
FIG. 16 is a side view of an exemplary embodiment of the surface tool of the present invention.

A fourth embodiment 86 may be illustrated in FIGS. 10 through 12. The fourth embodiment 86 may provide a fourth top 88 forming a dome-like shape having a curved surface and a flat surface. The flat surface may form two concentric recesses. The curved surface may form a stem aperture 92 communicating with the inner concentric recess. A sleeve 90 may circumscribe the stem aperture 92 on the flat surface that it perpendicularly extends from. The sleeve 90 may provide slots 94. Near the flat surface the sleeve 90 may provide a concentric top rim 96, as illustrated in FIG. 11.

The sleeve 90 may be dimensioned and adapted to slidably receive a stem 98. The stem 98 may provide at least two pinholes 100 near a second end.

The fourth embodiment 86 may provide a fourth base 108 having a cylindrical body with a first end and an opposing second end. The first end may define a first opening communicating to a threaded chamber 110. The second end may form a tapering spike adapted to puncture a grade surface. The tapering spike may include a plurality of perpendicularly joined spike plates. The fourth base 108 may provide a collar flange 112 along a periphery of the first opening. The collar flange 112 may be dimensioned and adapted to cooperating with the inner concentric recess of the fourth top 88 flat surface.

The fourth embodiment 86 may provide a lift anchor 102. The lift anchor 102 may be T-shaped wherein the trunk of the "T" provides at least two pins 106 for removably securing the at least two pinholes 100 so that the lift anchor 102 is disposed at the end of the second end. The arms 106 of the "T" may be dimensioned and adapted to operably engage the threaded chamber 110 so that the elevation of the stem 98 may be adjusted by rotating the lift anchor 102 secured to the stem 98.

In certain embodiments, such rotation may be enabled by rotating the fourth top 88 wherein include a locking collar 114 adapted to securely engage the collar flange 112 and the top rim 96 with its two halves 116 by use of tabs 118 and fasteners 120, 122. The locking collar 114 may be dimensioned and adapted to fit within the outer concentric recess of the fourth top 88.

Referring to FIGS. 13 through 16, the surface tool 130 may include a prying end 128, 134 and an opposing surface prep end. The prying end 128, 134 may form two tines. The prying end 128, 134 may have an approximate ¼ inch chamfer between the two tines. The surface prep end may be adapted to assist in prepping the surface grade for insertion of the present invention's spike portions 26, 45, 74. The two ends may be in a non-planar orientation from a traverse bend 126, 132 formed therebetween. The surface tool 130 may have ribbing plates 136 perpendicularly joined thereto for structural support.

It should be understood that "dome-shaped" is used by way of example and to aid in coordinating with the attached Figures. The above-mentioned tops 10, 32, 50, 88 may have any geometric shape that functions in accordance with the present invention as described herein, whereby there is a body of material having two opposing sides/surfaces—e.g., the flat surface and the curved surface.

A method of using the present invention may include the following. The training system disclosed above may be provided. The user may prep the grade surface by using the surface prep end of the surface tool 130. Then the user may secure the present invention into the surface grade by urging the spike portions 26, 45, 74 therein. Then for the second, third and fourth embodiment 30, 48, 86 the user may adjust and lock the desired elevation of the respective stem 38, 58, 98 by the methods disclosed above. Then the user may place a golf ball at the first end of the relevant stem so as to establish correct tee height in relationship to the club being used for training purposes. When done, the prying end of tool 130 is used.

It should be understood, of course, that the foregoing relates to exemplary embodiments of the invention and that modifications may be made without departing from the spirit and scope of the invention as set forth in the following claims.

What is claimed is:

1. An adjustable training golf tee, comprising:

a top body having a first side and a second side, wherein the second side forms a concentric threaded recess, wherein the first side forms a concentric stem aperture communicating the first side to the threaded recess;

a stem having a first end and a second end, wherein the first end is dimensioned and adapted to rest a golf ball thereon; and a base comprising:

a threaded flange;

a spike perpendicularly joined to the center of the threaded flange;

a tube interconnecting the threaded flange and the spike of the base;

a core disposed within a portion of the tube; and an annular grommet, wherein the annular grommet is dimensioned and adapted to be sandwiched between the first end threaded flange and a terminus of the mated threaded recess, wherein the stem is tubular, and wherein the annular grommet is dimensioned and adapted to slidably receive the tubular stem therein while the core slides within the tubular stem, wherein the threaded recess is dimensioned and adapted to rotatably mate with the threaded flange, and wherein the stem aperture is dimensioned and adapted to slidably receive the stem.

* * * * *